US012448583B2

(12) United States Patent
Shah et al.

(10) Patent No.: US 12,448,583 B2
(45) Date of Patent: Oct. 21, 2025

(54) LUBRICATING OIL COMPOSITION

(71) Applicants: CHEVRON ORONITE COMPANY LLC, San Ramon, CA (US); CHEVRON JAPAN LTD., Tokyo (JP)

(72) Inventors: Priyank Shah, Dublin, CA (US); Hiroki Andoh, Makinohara (JP); Masami Fuchi, Makinohara (JP); Takahiro Nakagawa, Omaezaki (JP); Ataru Minami, Omaezaki (JP); Satoshi Ohta, Matsudo (JP); Koichi Kubo, Kanagawa-Ku (JP)

(73) Assignees: CHEVRON ORONITE COMPANY LLC, San Ramon, CA (US); CHEVRON JAPAN LTD., Tokyo (JP)

( * ) Notice: Subject to any disclaimer, the term of this patent is extended or adjusted under 35 U.S.C. 154(b) by 0 days.

(21) Appl. No.: 18/839,545

(22) PCT Filed: Feb. 21, 2023

(86) PCT No.: PCT/IB2023/051571

§ 371 (c)(1),
(2) Date: Aug. 19, 2024

(87) PCT Pub. No.: WO2023/156989

PCT Pub. Date: Aug. 24, 2023

(65) Prior Publication Data

US 2025/0115824 A1 Apr. 10, 2025

Related U.S. Application Data

(60) Provisional application No. 63/312,122, filed on Feb. 21, 2022.

(51) Int. Cl.

| | |
|---|---|
| ***C10M 153/02*** | (2006.01) |
| ***C10M 169/04*** | (2006.01) |
| *C10N 30/00* | (2006.01) |
| *C10N 30/04* | (2006.01) |
| *C10N 30/06* | (2006.01) |
| *C10N 40/04* | (2006.01) |

(52) U.S. Cl.

CPC ..... *C10M 153/02* (2013.01); *C10M 169/041* (2013.01); *C10M 2203/003* (2013.01); *C10M 2225/04* (2013.01); *C10N 2030/04* (2013.01); *C10N 2030/06* (2013.01); *C10N 2030/45* (2020.05); *C10N 2040/04* (2013.01)

(58) Field of Classification Search

CPC ..... C10M 153/02; C10M 169/041; C10M 2203/003; C10M 2225/04; C10N 2030/04; C10N 2030/06; C10N 2030/45; C10N 2040/04

See application file for complete search history.

(56) References Cited

U.S. PATENT DOCUMENTS

| | | | | |
|---|---|---|---|---|
| 10,358,616 | B2 | 7/2019 | Gahagan | |
| 2002/0072478 | A1* | 6/2002 | Ishida | C10M 133/16 508/228 |
| 2007/0042918 | A1* | 2/2007 | Yanagi | C10M 159/12 508/346 |
| 2008/0096776 | A1* | 4/2008 | Carrick | C10M 141/12 508/192 |
| 2011/0028364 | A1* | 2/2011 | Shrestha | C10M 133/16 548/546 |
| 2014/0051617 | A1* | 2/2014 | Wilkes | C10M 133/46 508/286 |
| 2017/0015931 | A1* | 1/2017 | Watts | C10M 141/10 |
| 2018/0148663 | A1* | 5/2018 | Andoh | C10M 129/54 |
| 2019/0256792 | A1* | 8/2019 | Kubo | C10M 137/08 |
| 2019/0352575 | A1* | 11/2019 | Kubo | C10M 171/00 |
| 2021/0198592 | A1* | 7/2021 | Horita | C10M 133/44 |

FOREIGN PATENT DOCUMENTS

WO 2019162744 W 8/2019

OTHER PUBLICATIONS

PCT International Search Report mailed on May 15, 2023, issued in International Application No. PCT/IB2023/051571, filed on Feb. 21, 23, 3 pages.

* cited by examiner

*Primary Examiner* — Ellen M McAvoy

(57) ABSTRACT

This disclosure describes a lubricating oil composition that includes a major amount of an oil of lubricating viscosity and one or more nitrogen-containing additive having the formula:

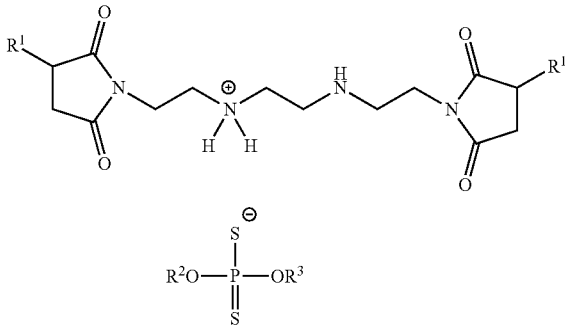

wherein $R^1$ is functional group containing 10 to 250 carbon atoms; and $R^2$ and $R^3$ are independently functional groups containing 2 to 20 carbon atoms.

20 Claims, No Drawings

LUBRICATING OIL COMPOSITION

CROSS-REFERENCE TO RELATED APPLICATIONS

This application is a national phase application of PCT/IB2023/051571 filed Feb. 21, 2023, which claims the priority benefit of U.S. Provisional Application No. 63/312,122, filed Feb. 21, 2022, which is hereby incorporated by reference in its entirety.

FIELD OF THE DISCLOSURE

The present disclosure relates to lubricating oil composition for internal combustion engine with transmission that utilizes wet clutch mechanism.

BACKGROUND

Modern lubricating oils are formulated to exacting specifications often set by original equipment manufacturers. To meet these requirements, carefully selected lubricant additives are blended together with base oils of lubricating viscosity. A typical lubricating oil composition may contain, for example, dispersants, detergents, antioxidants, wear inhibitors, rust inhibitors, corrosion inhibitors, foam inhibitors, and/or friction modifiers.

The specific application or use governs the set of additives that goes into a lubricating or engine oil composition. For example, motorcycle engine oil lubricates both the engine and the transmission which includes gears and a wet clutch mechanism and, consequently, the drivetrain is affected by the engine oil. By contrast, a passenger car can have dry or wet clutch but the drivetrain is typically not affected by the engine oil.

Additionally, a wet clutch is often made from cellulose fiber and/or aramid fiber which factors into the design of motorcycle engine oil. For example, zinc dithiophosphate (ZnDTP) is widely used as a conventional anti-wear additive in engine oil. However, use of ZnDTP in motorcycles presents challenges because ZnDTP can form sludge in the porous parts of the paper clutch which can result in clogging. Clogging can lead to a deterioration in cooling by the oil and of the clutch material.

For some applications (e.g., automatic transmission fluid), ZnDTP has been largely phased out and replaced by sulfur-phosphorus additives. However, it is not yet practical to entirely remove ZnDTP from motorcycle engine oils. Moreoever, low sulfated ash or s-ash is generally desirable where wet paper clutches are used. For these reasons and more, there is a need for engine oils specifically formulated for motorcycles.

SUMMARY OF THE INVENTION

In one aspect, the present invention relates to a lubricating oil composition comprising a major amount of an oil of lubricating viscosity and one or more nitrogen-containing additive having the formula:

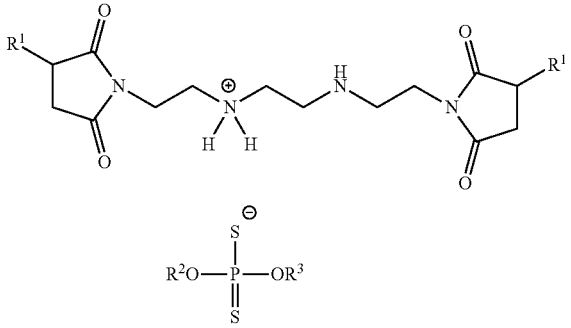

wherein $R^1$ is a functional group containing 10 to 250 carbon atoms; and $R^2$ and $R^3$ are independently functional groups containing 2 to 20 carbon atoms.

In another aspect, the present invention relates to a method of increasing the friction coefficient of a wet clutch comprising contacting a metal surface with a lubricating oil composition comprising a major amount of an oil of lubricating viscosity and one or more nitrogen-containing additive having the formula:

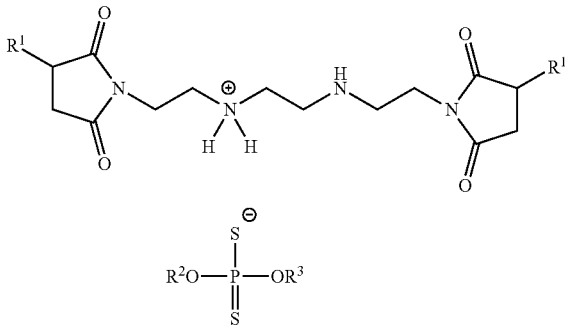

wherein $R^1$ is a functional group containing 10 to 250 carbon atoms; and $R^2$ and R3 are independently functional groups containing 2 to 20 carbon atoms.

DETAILED DESCRIPTION

Definitions

The following terms will be used throughout the specification and will have the following meanings unless otherwise indicated.

The term "a major amount" of oil of lubricating viscosity refers to where the amount of base oil is at least 40 wt. % of the lubricating oil composition. In some embodiments, "a major amount" refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

The term "succinimide" is understood in the art to include many of the amide, imide, and amidine species which may be formed by the reaction of a succinic anhydride with an amine. The predominant product, however, is a succinimide and this term has been generally accepted as meaning the product of a reaction of succinic acid (or substituted succinic acid) or anhydride with an amine. Substituted succinimides are disclosed in numerous references and are well known in the art. Certain fundamental types of succinimides and related materials encompassed by the term of art "succinimide" are taught in U.S. Pat. Nos. 2,992,708; 3,018,291; 3,024,237; 3,100,673; 3,219,666; 3,172,892; and 3,272,746.

This disclosure relates to lubricant additive composition and its formulation in lubricating oil composition that are specifically designed for engines found in motorcycles. The composition or compositions lead to a reduction in sulfated ash and/or maintain a high coefficient of friction associated with the clutch torque capacity of the wet clutch.

In another aspect, the present disclosure is directed to novel composition that is particularly useful as lubricant additive for engines using wet clutch mechanism such as those in motorcycles, construction machineries, and/or industrial machineries.

The lubricating oil composition comprising the lubricant additive can maintain high level of engine oil performance such as excellent wet clutch friction properties, excellent anti-wear properties, and/or reduced levels of sulfated ash. The lubricating oil composition can exhibit improved anti-wear performance even with low levels of conventional anti-wear additives such as ZnDTP.

Moreover, the lubricating oil composition comprising the lubricant additive may prevent catalyst poisoning for exhaust gas regulation and/or misfire due to spark plug dirt, while maintaining a high friction coefficient of friction so as not to reduce the clutch torque transmission capacity of the wet clutch. Furthermore, the lubricating oil composition can maintain low amounts of s-ash and phosphorus which is generally desirable for motorcycle engines.

In one embodiment, the present invention provides a lubricating oil composition comprising: a base oil of lubricating viscosity and a nitrogen-containing additive. In some embodiments, the lubricating oil composition contains less than about 900 ppm of zinc. In some embodiments, the lubricating oil composition contains reduced sulfated ash content such as from about 0.3 wt % to about 1.2 wt % based on the total lubricating oil composition.

The lubricating oil compositions of the present application generally have SAE viscosity grade of 0W-16, 0W-20, 0W-30, 5W-30, 10W-30, 0W-40, 5W-40, 10W-40, 15W-40, 0W-50, 5W-50, 10W-50, 20W-40, 20W-50, or 10W-60.

The lubricating oil compositions generally have a viscosity index of greater than about 120, or greater than about 135, or greater than about 150, or greater than about 180, or greater than about 200 up to about 270 or more.

Additional considerations may be important for engine oil that lubricate not only the engine but also the transmission. For example, if the kinematic viscosity at low temperature is high, the startability is poor, while at high temperature, the kinematic viscosity must be maintained high to prevent gear wear and pitting. The viscosity index is an important factor not only for the fuel economy but also for startability and transmission durability.

The Base Oil of Lubricating Viscosity

The lubricating oil compositions disclosed herein generally comprise at least one base oil of lubricating viscosity. Any base oil known to a skilled artisan can be used as the oil of lubricating viscosity disclosed herein. Some base oils suitable for preparing the lubricating oil compositions have been described in Mortier et al., "Chemistry and Technology of Lubricants," 2nd Edition, London, Springer, Chapters 1 and 2 (1996); and A. Sequeria, Jr., "Lubricant Base Oil and Wax Processing," New York, Marcel Decker, Chapter 6, (1994); and D. V. Brock, Lubrication Engineering, Vol. 43, pages 184-5, (1987), all of which are incorporated herein by reference.

Generally, the amount of the base oil in the lubricating oil composition is a "a major amount" of oil of lubricating viscosity as defined above.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process.

In some embodiments, the base oil has a kinematic viscosity at 100° C. from about 2.5 centistokes (cSt) to about 40 cSt, such as from about 4 centistokes (cSt) to about 30 cSt, from about 5 cSt to about 16 cSt, from about 6 cSt about 15 cSt, from about 2.5 cSt to about 35 cSt, from about 2.5 cSt to about 30 cSt, from about 2.5 cSt to about 25 cSt, from about 4 cSt to about 25 cSt, from about 4 cSt to about 20 cSt, from about 5 cSt to about 40 cSt, from about 5 cSt to about 35 cSt, from about 6 cSt to about 40 cSt, or from about 6 cSt to about 30 cSt. The kinematic viscosity of the base oils or the lubricating oil compositions disclosed herein can be measured according to ASTM D445, a standardized protocol provided by ASTM International and herein incorporate by reference.

In some embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock is substantially free from materials introduced through manufacturing, contamination, or previous use.

In some embodiments, the base oil comprises one or more of the base stocks in one or more of Groups I-V as specified in the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference. The API guideline defines a base stock as a lubricant component that can be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

In some embodiments, the base oil comprises one or more of the base stocks from Group I, II, III, IV, V, including any combinations thereof. In other embodiments, the base oil comprises one or more of the base stocks from Group II, III, IV, including any combinations thereof.

The base oil may comprise natural oils of lubricating viscosity, synthetic oils of lubricating viscosity and/or mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the base oil of lubricating viscosity includes natural oils, such as animal oils, vegetable oils, mineral oils (e.g., liquid petroleum oils and solvent treated or acid-treated mineral oils of the paraffinic, naphthenic or mixed paraffinic-naphthenic types), oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In some embodiments, the synthetic oils of lubricating viscosity include hydrocarbon oils and/or halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyakyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 2 to about 40, from about 4 to about 20, or from about 6 to about 16 carbon atoms. Non-limiting examples of suitable poly-alpha-olefins include those derived from octene, decene, mixtures thereof, and the like. These poly-alpha-olefins may have a viscosity from about 2 cSt to about 40 cSt, such as from about 2 cSt to about 30 cSt, from about 2 cSt to about 20 cSt, from about 2 cSt to about 12 cSt, from about 3 cSt to about 40 cSt, from about 3 cSt to about 30 cSt, from about 3 cSt to about 20 cSt, from about 3 cSt to about 12 cSt, or from about 4 to about 10 centistokes at 100° C. In some instances, the poly-alpha-olefins may be used together with other base oils such as mineral oils.

In further embodiments, the base oil comprises a polyalkylene glycol or a polyalkylene glycol derivative, wherein the terminal hydroxyl groups of the polyalkylene glycol or derivative may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono-and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

Nitrogen-Containing Additives

The lubricating oil composition of the present invention includes one or more nitrogen-containing additive described herein. In one aspect, the nitrogen-containing additive is the reaction product of succinimide and thiophosphate acid or acid ester.

The succinimide in the reaction may include or be substituted with an alkyl group, cyclic group, aromatic group, or heteroatom-containing group. Suitable examples of functional groups include 2-ethoxyethanol, 2(2-ethoxyethoxy) ethanol, 2-cyclohexyloxyethanol, 2-phenoxyethanol, and ethoxylated alkylphenol.

The succinimide reacts or forms a salt with the thiophosphate acid ester in its bis form (i.e., bis-succinimide). The reaction product can be represented by Formula I shown below:

Formula I

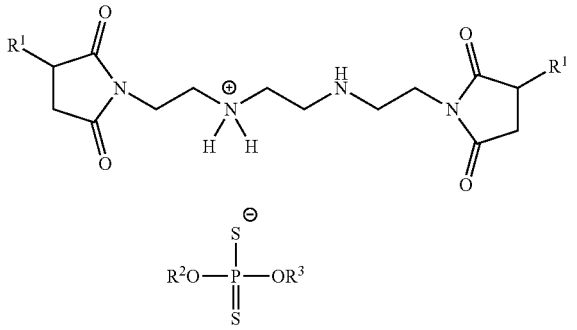

wherein $R^1$ is a functional group containing 10 to 250 carbon atoms, such as from about 20 to about 200 carbon atoms, from about 30 to about 150 carbon atoms, or from about 30 to about 100 carbon atoms. $R^2$ and $R^3$ are independently functional groups (e.g., primary alkyl, secondary alkyl, etc.) containing 2 to 20 carbon atoms, such as about 3 to 18 carbon atoms, or about 3 to 12 carbon atoms. Specific examples of $R^2$ or $R^3$ include 2-ethylhexyl, 2-butyl and 4-methyl-2-pentyl groups.

The nitrogen-containing additive may be present in an amount ranging from about 0.5 wt. % to about 5.0 wt. % based on the total weight of the lubricating oil composition, such as from about 0.7 wt. % to about 4.5 wt. %, from about 1.0 wt. % to about 4.0 wt. %, from about 1.0 wt. % to about 3.5 wt. %, and so forth.

In some embodiments, the nitrogen-containing additive may be present in an amount to provide about 100 ppm to about 5000 ppm of phosphorus based on the total weight of lubricating oil composition, such as from about 100 ppm to about 4000 ppm, from about 1000 ppm to about 3000 ppm.

Succinimides can be prepared by any known method such as those described in, for example, U.S. Patent Publication No. 20180034635 and U.S. Pat. No. 7,091,306, which are hereby incorporated by reference.

As an illustrative example, a substituted succinimide (e.g., alkyl-substituted succinimide) can be obtained as the product of a reaction of alkyl-substituted succinic anhydrides with a polyamine. In lubricating oil applications, the succinic anhydrides are typically substituted in alpha position by an alkyl chain such as polyisobutylene (PIBSA) or PIBSA-type moiety. In an embodiment, $R^1$ is a polyisobutenyl substituent derived from a polyisobutene wherein the polyisobutenyl substituent has 10 to 250 carbon atoms. In some embodiments, $R^1$ has a molecular weight ranging from about 120 to about 3000 such as from about 700 to about 2500, from about 800 to about 2000, and from about 900 to about 1500.

For lubricating oil application, polyalkylene polyamine may be particularly useful. However, other polyamines compatible with the present invention may be used. The polyamine can react with the alkyl-substituted succinic anhydride to produce, according to their molar ratio, mono-succinimides, bis-succinimides, tris-succinimides or mixtures of thereof.

Suitable polyamines can have a straight-or branched-chain structure and may be cyclic, acylic, or combinations thereof. In some embodiments, polyalkylene polyamines may be used to prepare the bis-succinimide dispersants. Such polyalkylene polyamines will typically contain about 2 to about 12 nitrogen atoms and about 2 to 24 carbon atoms. Particularly suitable polyalkylene polyamines include those having the formula: H2N—(R'NH)x-H wherein R' is a straight- or branched-chain alkylene group having 2 or 3 carbon atoms and x is 1 to 9. Representative examples of suitable polyalkylene polyamines include diethylenetriamine (DETA), triethylenetetramine (TETA), tetraethylenepentamine (TEPA), pentaethylene hexamine (PEHA), and heavier poly-alkylene-amines (HPA).

In some embodiments, the polyamine may contain cyclic groups. Specific examples include N, N'-bis-(2-aminoethyl) piperazine) (Bis AEP), N-[(2-aminoethyl) 2-aminoethyl] piperazine) (PEEDA), 1-(2-aminoethyl)-4-[(2-aminoethyl) amino]ethyl]-piperazine) (AEPEEDA) and 1-[2-[[2-[(2-aminoethyl)amino]ethyl]amino]ethyl]-piperazine) (PEDETA).

Many of the polyamines suitable for use in the present invention are commercially available and others may be prepared by methods which are well known in the art. For example, methods for preparing amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99 116.

Generally, the substituted succinic anhydride is reacted with the polyamine at a temperature of about 130° C. to 220° C. (e.g., 140° C. to 200° C., 145° C. to 175° C., etc.). The reaction can be carried out under an inert atmosphere, such as nitrogen or argon. Generally, a suitable molar charge of polyamine to the substituted succinic anhydride is from about 0.35:1 to about 1:1 (e.g., 0.4:1 to 0.75:1). As used herein, the "molar charge of polyamine to substituted succinic anhydride" means the ratio of the number of moles of polyamine to the number of succinic groups in the succinic anhydride reactant.

In general, synthesis of thiophosphate acid esters is known. For example, thiophosphate acid esters can be prepared by treating phosphorus pentasulfide with a stoichiometric excess of alcohol. This reaction typically takes place in a non-reactive solvent while removing hydrogen sulfide which is liberated.

The Charge Mole Ratio (CMR) of the polyamine to the dithiophosphoric acid may be important to ensure correct reaction product. In some embodiments, the Charge Mole Ratio (CMR) of the polyamine to the dithiophosphoric acid ester is about 1:1. In some embodiments, an excess of the dithiophosphoric acid ester is used such that the Charge Mole Ratio of polyamine to the acid ester is about 1:2. Other CMR may also result in desirable nitrogen-containing additives.

Other Additives

To the extent that it is consistent with the ingredients and properties of the lubricating composition described above, the lubricating oil composition may further comprise an additive or a modifier (hereinafter designated as "additive") that can impart or improve any desirable property of the lubricating oil composition. Any additive known to a person of ordinary skill in the art may be used in the lubricating oil compositions disclosed herein. Some suitable additives have been described in Mortier et al., "Chemistry and Technology of Lubricants," 2nd Edition. London, Springer, (1996); and Leslie R. Rudnick, "Lubricant Additives: Chemistry and Applications," New York, Marcel Dekker (2003), both of which are incorporated herein by reference. In some embodiments, the additive can be selected from the group consisting of antioxidants, antiwear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof. Certain additives are multifunctional and can be placed in more than one category.

In general, the concentration of each of the additives in the lubricating oil composition, when used, may range from about 0.001 wt. % to about 10 wt. %, from about 0.01 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

Detergents

Any detergent compatible with the present invention may be used. Some suitable detergents have been described in Mortier et al., "Chemistry and Technology of Lubricants," 2nd Edition, London, Springer, Chapter 3, pages 75-85 (1996); and Leslie R. Rudnick, "Lubricant Additives: Chemistry and Applications," New York, Marcel Dekker, Chapter 4, pages 113-136 (2003), both of which are incorporated herein by reference.

Suitable detergents include oil-soluble overbased sulfonate, non-sulfonate containing phenate, sulfurized phenate, salixarate, salicylate, saligenin, complex detergents and naphthenate detergents and other oil-soluble alkylhydroxybenzoates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

Anti-Wear Agents

Optionally, the lubricating oil composition disclosed herein can comprise one or more anti-wear agents. Anti-wear agents reduce wear of metal parts. Suitable anti-wear agents include zinc dithiophosphate (ZnDTP) or zinc dihydrocarbyl dithiophosphates (ZDDP) of the following structure: $Zn[S—P(=S)(OR1)(OR2)]_2$ wherein R1 and R2 may be the same of different hydrocarbyl radicals having from 1 to 18 (e.g., 2 to 12) carbon atoms and including radicals such as alkyl, alkenyl, aryl, arylalkyl, alkaryl and cycloaliphatic radicals. Particularly preferred as R1 and R2 groups are alkyl groups having from 2 to 8 carbon atoms (e.g., the alkyl radicals may be ethyl, n-propyl, isopropyl, n-butyl, isobutyl, sec-butyl, n-pentyl, isopentyl, n-hexyl, isohexyl, 2-ethylhexyl). In order to obtain oil solubility, the total number of carbon atoms (i.e., R1+R2) will be at least 5. The zinc dihydrocarbyl dithiophosphate can therefore comprise zinc dialkyl dithiophosphates. The zinc dialkyl dithiophosphate is a primary, secondary zinc dialkyl dithiophosphate, or a combination thereof. ZDDP or ZnDTP may be present at 1.5 wt. % or less (e.g., 0.1 to 1.0 wt. %, or 0.3 to 1.0 wt %) of the lubricating oil composition.

Dispersants

Optionally, the lubricating oil composition disclosed herein can further comprise a dispersant. Dispersants maintain in suspension materials resulting from oxidation during engine operation that are insoluble in oil, thus preventing sludge flocculation and precipitation or deposition on metal parts. Dispersants useful herein include nitrogen-containing, ashless (metal-free) dispersants known to effective to reduce formation of deposits upon use in gasoline and diesel engines. Suitable dispersants include hydrocarbyl succinimides, hydrocarbyl succinimides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also suitable are condensation products of polyamines and hydrocarbyl-substituted phenyl acids. Mixtures of these dispersants can also be used.

Basic nitrogen-containing ashless dispersants are well-known lubricating oil additives and methods for their preparation are extensively described in the patent literature. Preferred dispersants are the alkenyl succinimides and succinimides where the alkenyl-substituent is a long-chain of preferably greater than 40 carbon atoms. These materials are readily made by reacting a hydrocarbyl-substituted dicarboxylic acid material with a molecule containing amine functionality. Examples of suitable amines are polyamines such as polyalkylene polyamines, hydroxy-substituted polyamines and polyoxyalkylene polyamines. As is known in the art, the dispersants may be post-treated (e.g., with a boronating agent, ethylene carbonate, or a cyclic carbonate). Nitrogen-containing ashless (metal-free) dispersants are basic and contribute to the TBN of a lubricating oil composition to which they are added, without introducing additional sulfated ash. Dispersants may be present at 0.1 to 10 wt. % (e.g., 0.5 to 8, 0.7 to 7, 0.7 to 6, 0.7 to 6, 0.7 to 5, 0.7 to 4 wt. %), based on an actives level, of the lubricating oil composition. Nitrogen from the dispersants is present from greater than 0.0050 to 0.30 wt. % (e.g., greater than 0.0050 to 0.10 wt. %, 0.0050 to 0.080 wt. %, 0.0050 to 0.060 wt. %, 0.0050 to 0.050 wt. %, 0.0050 to 0.040 wt. %, 0.0050 to 0.030 wt. %) based on the weight of the dispersants in the finished oil.

Antioxidants

Optionally, the lubricating oil composition disclosed herein can further comprise an antioxidant that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines, phenyl-.alpha.-naphthylamine, alkyl or aralkyl substituted phenyl-.alpha.-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), certain molybdenum complexes, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York. Marcel Dekker, Chapter 1, pages 1-28 (2003), which is incorporated herein by reference.

In particular, molybdenum complex formed as the reaction product of molybdenum oxysulfide and mono succinimide are effective at preventing oxidative degradation as well as deterioration due to $NO_x$. The molybdenum complexes may be present in an amount that provides about 500 ppm or less of molybdenum to the lubricating oil composition, such as about or less than 400 ppm, such as about or less than 300 ppm.

Suitable molybdenum-succinimide complexes are described, for example, in U.S. Pat. No. 8,076,275, which is hereby incorporated by reference. These complexes are prepared by a process comprising reacting an acidic molybdenum compound with an alkyl or alkenyl succinimide.

Pour Point Depressants

The lubricating oil composition disclosed herein can optionally comprise a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di (tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "Chemistry and Technology of Lubricants," 2nd Edition, London, Springer, Chapter 6, pages 187-189 (1996); and Leslie R. Rudnick, "Lubricant Additives: Chemistry and Applications," New York, Marcel Dekker, Chapter 11, pages 329-354 (2003), both of which are incorporated herein by reference.

Demulsifiers

The lubricating oil composition disclosed herein can optionally comprise a demulsifier that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "Chemistry and Technology of Lubricants," 2nd Edition. London, Springer, Chapter 6, pages 190-193 (1996), which is incorporated herein by reference.

Foam Inhibitors

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. The amount of the anti-foam may vary from about 0.0001 wt. % to about 0.50 wt. %, from about 0.001 wt. % to about 0.1 wt. %, or from about 0.1 wt. % to about 0.05 wt. %, based on the total weight of the lubricating oil composition. Some suitable anti-foams have been described in Mortier et al., "Chemistry and Technology of Lubricants," 2nd Edition, London, Springer, Chapter 6, pages 190-193 (1996), which is incorporated herein by reference.

Corrosion Inhibitors

The lubricating oil composition disclosed herein can optionally comprise a corrosion inhibitor that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines, and combinations thereof. The amount of the corrosion inhibitor may vary from about 0.01 wt. % to about 5 wt. %, from about 0.03 wt. % to about 3 wt. %, or from about 0.05 wt. % to about 1 wt. %, based on the total weight of the lubricating oil composition. Some suitable corrosion inhibitors have been described in Mortier et al., "Chemistry and Technology of Lubricants," 2nd Edition, London, Springer, Chapter 6, pages 193-196 (1996), which is incorporated herein by reference.

Extreme Pressure Agents

The lubricating oil composition disclosed herein can optionally comprise an extreme pressure (EP) agent that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. Zinc diallyl dithiophosphate, described as an anti-wear agents, is also often used as an extreme pressure agent. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "Lubricant Additives: Chemistry and Applications," New York, Marcel Dekker, Chapter 8, pages 223-258 (2003), which is incorporated herein by reference.

Rust Inhibitors

The lubricating oil composition disclosed herein can optionally comprise a rust inhibitor that can inhibit the corrosion of ferrous metal surfaces. Any rust inhibitor known by a person of ordinary skill in the art may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha,omega-dicarboxylic acids having a molecular weight in the range of 600 to 3000 daltons and combinations thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

Multifunctional Additives

In some embodiments, the lubricating oil composition comprises at least a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

Viscosity Modifiers

In certain embodiments, the lubricating oil composition comprises at least a viscosity modifier. Some non-limiting examples of suitable viscosity modifiers include polymethacrylate type polymers, ethylene-propylene copolymers, styrene-isoprene copolymers, hydrated styrene-isoprene copolymers, polyisobutylene, and dispersant type viscosity modifiers.

Metal Deactivators

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

Additive Concentrate Formulations

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 centistokes to about 35 centistokes at 40° C.

Generally, it is desired that the diluent readily solubilizes the lubricating oil soluble additive and provides an oil additive concentrate that is readily soluble in the lubricant base oil stocks or fuels. In addition, it is desired that the diluent not introduce any undesirable characteristics, including, for example, high volatility, high viscosity, and impurities such as heteroatoms, to the lubricant base oil stocks and thus, ultimately to the finished lubricant or fuel.

The present application further provides an oil soluble additive concentrate composition comprising an inert diluent and from 2.0% to 90% by weight, preferably 10% to 50% by weight based on the total concentrate, of an oil soluble additive composition according to the present application.

The oil lubricating compositions comprising the additives described above may be employed in a method for improving fuel economy in an internal combustion engine comprising lubricating said engine with the lubricating oil composition comprising the additives and operating the engine.

The following examples are presented to exemplify embodiments but are not intended to limit the application to the specific embodiments set forth. Unless indicated to the contrary, all parts and percentages are by weight. All numerical values are approximate. When numerical ranges are given, it should be understood that embodiments outside the stated ranges may still fall within the scope of the application. Specific details described in each example should not be construed as necessary features.

EXAMPLES

The following examples are intended for illustrative purposes only and do not limit in any way the scope.

Preparation of the PIB-substituted nitrogen-containing additives (Examples 1-4) is disclosed herein. Examples 1-4 only differ in the amount of starting materials used as summarized in Table 1.

Example 1

A three-neck round-bottom flask was charged with 100 g (35.6 mmol) of 1000 MW PIB bis-succinimide (nitrogen content=2.0 wt. %) prepared from triethylenetetramine. The round-bottom flask was equipped with overhead stirrer, thermocouple, dropping funnel and nitrogen inlet. Afterwards, the flask was placed in thermal contact with a heating mantle and temperature was raised to 80° C. Next, 9.14 g (35.6 mmol) of dialkyl dithiophosphoric acid was added to the flask through the dropping funnel over a period of 2.0 h. The temperature was then raised to 100° C. and maintained for 2.0 h. The reaction mixture was used without purification.

Example 2

A three-neck round-bottom flask was charged with 99.06 g (35.4 mmol) of 1000 MW PIB bis-succinimide (nitrogen content=2.0 wt. %) prepared from triethylenetetramine. The round-bottom flask was equipped with overhead stirrer, thermocouple, dropping funnel and nitrogen inlet. Afterwards, the flask was placed in thermal contact with a heating mantle and temperature was raised to 80° C. Next, 12.58 g (35.4 mmol) of dialkyl dithiophosphoric acid was added to the flask through the dropping funnel over a period of 2.0 h. The temperature was then raised to 100° C. and maintained for 2.0 h. The reaction mixture was used without purification.

Example 3

A three-neck round-bottom flask was charged with 91.0 g (32.5 mmol) of 1000 MW PIB bis-succinimide (nitrogen content=2.0 wt. %) prepared from triethylenetetramine. The round-bottom flask was equipped with overhead stirrer, thermocouple, dropping funnel, and nitrogen inlet. Afterwards, the flask was placed in thermal contact with a heating mantle and temperature was raised to 80° C. Next, 16.6 g (65.0 mmol) of dialkyl dithiophosphoric acid was added to the flask through the dropping funnel over a period of 2.0 h. The temperature was then raised to 100° C. and maintained for 2.0 h. The reaction mixture was used without purification.

Example 4

A three-neck round-bottom flask was charged with 100.3 g (35.8 mmol) of 1000 MW PIB bis-succinimide (nitrogen content=2.0 wt. %) prepared from triethylenetetramine. The round-bottom flask was equipped with overhead stirrer, thermocouple, dropping funnel, and nitrogen inlet. Afterwards, the flask was placed in thermal contact with a heating mantle and temperature was raised to 80° C. Next, 25.5 g (71.9 mmol) of dialkyl dithiophosphoric acid was added to the flask through the dropping funnel over a period of 2.0 h. The temperature was then raised to 100° C. and maintained for 2.0 h. The reaction mixture was used without purification.

TABLE 1

| Description | Example 1 | Example 2 | Example 3 | Example 4 |
|---|---|---|---|---|
| Polyamine | 100% TETA | 100% TETA | 100% TETA | 100% TETA |
| Functional group(s) on dialkyl dithiophosphoric acid (mole ratio %) | 2-butanol (31%) + 2Methyl Pentanol (69%) | 2-ethyl hexanol | 2-butanol (31%) + 2Methyl Pentanol (69%) | 2-ethyl hexanol |
| Charge Mole Ratio of polyamine to dialkyl dithiophosphoric acid | 1:1 | 1:1 | 1:2 | 1:2 |
| PIB Molecular Weight (MW) | 950 | 950 | 950 | 950 |
| Nitrogen, wt % | 1.813 | 1.812 | 1.732 | 1.616 |
| P cont., % wt | 1.065 | 0.932 | 1.752 | 1.701 |
| S cont., % wt | 1.96 | 1.78 | 3.142 | 3.247 |

Comparative Example 1 (Table 5) is an API SN class 5W-30 motorcycle engine oil. Examples A-D (Table 5) are test oils formulated using the reaction product of Example 1, Example 2, Example 3 and Example 4 (Table 1). For these samples, the amount ZnDTP used in Comparative Example1 was reduced in favor of nitrogen-containing additives of Examples 1, 2, 3 and 4. The phosphorus content, which is an index of the amount of anti-wear agent added, is unified to the same level.

SAE No.2 wet clutch test (JASO M348:2012) specified in the 4-stroke motorcycle engine oil standard (JASO T903:2016) were carried out using each test oils (Examples A-D and Comparative Example 1), and evaluated in comparison with the JASO reference oils (JATRE-A16 and B16).

Friction Properties of a Clutch System

Friction tests were carried out on the test oils and JASO reference oils JAFRE-A16 and B16 using the SAE No.2 clutch test machine. The friction plates were frictionally engaged with the steel plates while submerged in the oil at the specified temperature. Measurements were taken for the dynamic friction coefficients ($m_d$), stop time (ST), and static friction coefficients ($m_s$) corresponding to the number of revolutions the plates are subjected to.

The coefficient of dynamic friction is related to the friction force when the clutch is engaged. The stop time is the time until the wet clutch synchronizes. The coefficient of the static friction is related to the transmission torque capacity of the wet clutch.

Measurement of these values provided evaluation of the friction properties of the test oils (Examples A-D and Comparative Example 1) and JASO reference oils JAFRE-A16 and B16. The tests were prepared and conducted in accordance with JASO M 348:2012, 3.2 and JASO M 348:2012, 3.3.

Dynamic Friction Test

The dynamic friction test was conducted in accordance with JASO M 348:2012, 3.3.1 (slightly modified such that the number of test cycles was 1,000). Test results of the dynamic friction coefficient are summarized in Table 2 below.

TABLE 2

(Dynamic Friction Coefficients)

| | μd, Cycles | | | | | | | | | |
|---|---|---|---|---|---|---|---|---|---|---|
| | 1 | 5 | 10 | 20 | 50 | 100 | 200 | 300 | 400 | 500 |
| JAFRE A-16 | 0.142 | 0.157 | 0.157 | 0.157 | 0.149 | 0.143 | 0.138 | 0.136 | 0.133 | 0.134 |
| JAFRE B-16 | 0.143 | 0.137 | 0.135 | 0.128 | 0.112 | 0.105 | 0.098 | 0.094 | 0.091 | 0.089 |
| Comp Example 1 | 0.142 | 0.150 | 0.149 | 0.151 | 0.146 | 0.138 | 0.134 | 0.131 | 0.130 | 0.127 |
| Example A | 0.141 | 0.145 | 0.144 | 0.148 | 0.147 | 0.136 | 0.133 | 0.132 | 0.131 | 0.130 |
| Example B | 0.137 | 0.142 | 0.142 | 0.146 | 0.149 | 0.144 | 0.136 | 0.136 | 0.133 | 0.133 |

TABLE 2-continued

| (Dynamic Friction Coefficients) | | | | | | | | | | |
|---|---|---|---|---|---|---|---|---|---|---|
| Example C | 0.136 | 0.141 | 0.144 | 0.147 | 0.142 | 0.138 | 0.133 | 0.133 | 0.131 | 0.128 |
| Example D | 0.138 | 0.142 | 0.142 | 0.147 | 0.152 | 0.142 | 0.136 | 0.135 | 0.133 | 0.133 |

| | μd, Cycles | | | | |
|---|---|---|---|---|---|
| | 600 | 700 | 800 | 900 | 1000 |
| JAFRE A-16 | 0.134 | 0.134 | 0.133 | 0.133 | 0.132 |
| JAFRE B-16 | 0.089 | 0.089 | 0.092 | 0.093 | 0.094 |
| Comp Example 1 | 0.125 | 0.124 | 0.124 | 0.124 | 0.122 |
| Example A | 0.131 | 0.130 | 0.131 | 0.131 | 0.135 |
| Example B | 0.133 | 0.133 | 0.132 | 0.132 | 0.132 |
| Example C | 0.128 | 0.128 | 0.129 | 0.130 | 0.130 |
| Example D | 0.133 | 0.135 | 0.135 | 0.134 | 0.135 |

Static Friction Test

The static friction test was conducted in accordance with JASO M 348:2012 3.3.2. Properties were measured at test cycle numbers 10, 50, 100, and every 100 cycles thereafter up to 1,000 cycles in the dynamic friction test. Test results of the static friction coefficients are summarized in Table 3.

TABLE 3

| (Static Friction Coefficients) | | | | | | | | | | |
|---|---|---|---|---|---|---|---|---|---|---|
| | μs, Cycles | | | | | | | | | |
| | 1 | 5 | 10 | 20 | 50 | 100 | 200 | 300 | 400 | 500 |
| JAFRE A-16 | 0.180 | 0.180 | 0.173 | 0.170 | 0.164 | 0.158 | 0.150 | 0.147 | 0.146 | 0.150 |
| JAFRE B-16 | 0.190 | 0.166 | 0.167 | 1.640 | 0.140 | 0.126 | 0.115 | 0.110 | 0.107 | 0.105 |
| Comp Example 1 | 0.180 | 0.163 | 0.158 | 0.161 | 0.153 | 0.146 | 0.136 | 0.137 | 0.133 | 0.129 |
| Example A | 0.188 | 0.171 | 0.164 | 0.163 | 0.150 | 0.142 | 0.137 | 0.135 | 0.135 | 0.132 |
| Example B | 0.183 | 0.164 | 0.158 | 0.159 | 0.151 | 0.145 | 0.140 | 0.137 | 0.139 | 0.137 |
| Example C | 0.179 | 0.167 | 0.168 | 0.163 | 0.147 | 0.142 | 0.142 | 0.138 | 0.138 | 0.135 |
| Example D | 0.180 | 0.163 | 0.158 | 0.156 | 0.149 | 0.145 | 0.143 | 0.142 | 0.137 | 0.141 |

| | μs, Cycles | | | | |
|---|---|---|---|---|---|
| | 600 | 700 | 800 | 900 | 1000 |
| JAFRE A-16 | 0.153 | 0.151 | 0.153 | 0.148 | 0.152 |
| JAFRE B-16 | 0.103 | 0.105 | 0.104 | 0.105 | 0.106 |
| Comp Example 1 | 0.129 | 0.129 | 0.129 | 0.129 | 0.129 |
| Example A | 0.133 | 0.137 | 0.139 | 0.144 | 0.146 |
| Example B | 0.140 | 0.137 | 0.135 | 0.137 | 0.141 |
| Example C | 0.137 | 0.137 | 0.140 | 0.139 | 0.144 |
| Example D | 0.146 | 0.142 | 0.144 | 0.145 | 0.142 |

The results shown in Tables 2 and 3 demonstrate that the test oils Example A to D using the compounds of Examples 1 to 4 of the invention significantly increase the dynamic and static friction coefficients compared to Comparative Example 1.

Stop Time

Stop Time (ST) is the period of time starting from when a pushing pressure of 30% of the set value is applied and ending when the revolution speed of 200 $min^{-1}$ or less, in the dynamic friction test. Results of stop time are summarized in Table 4.

TABLE 4

(Stop Time)

| | ST, Cycles | | | | | | | | | |
|---|---|---|---|---|---|---|---|---|---|---|
| | 1 | 5 | 10 | 20 | 50 | 100 | 200 | 300 | 400 | 500 |
| JAFRE A-16 | 0.784 | 0.706 | 0.712 | 0.712 | 0.740 | 0.760 | 0.792 | 0.802 | 0.810 | 0.812 |
| JAFRE B-16 | 0.766 | 0.788 | 0.802 | 0.838 | 0.944 | 1.010 | 1.068 | 1.124 | 1.164 | 1.190 |
| Comp Example 1 | 0.788 | 0.740 | 0.744 | 0.738 | 0.754 | 0.794 | 0.820 | 0.846 | 0.846 | 0.860 |
| Example A | 0.788 | 0.754 | 0.758 | 0.742 | 0.764 | 0.810 | 0.834 | 0.836 | 0.848 | 0.852 |
| Example B | 0.806 | 0.770 | 0.766 | 0.750 | 0.744 | 0.776 | 0.808 | 0.816 | 0.826 | 0.828 |
| Example C | 0.814 | 0.774 | 0.756 | 0.746 | 0.778 | 0.810 | 0.830 | 0.836 | 0.846 | 0.852 |
| Example D | 0.800 | 0.770 | 0.768 | 0.748 | 0.730 | 0.778 | 0.808 | 0.826 | 0.832 | 0.832 |

| | ST, Cycles | | | | |
|---|---|---|---|---|---|
| | 600 | 700 | 800 | 900 | 1000 |
| JAFRE A-16 | 0.810 | 0.814 | 0.814 | 0.822 | 0.822 |
| JAFRE B-16 | 1.192 | 1.194 | 1.168 | 1.152 | 1.150 |
| Comp Example 1 | 0.874 | 0.872 | 0.878 | 0.884 | 0.890 |
| Example A | 0.856 | 0.854 | 0.846 | 0.846 | 0.818 |
| Example B | 0.830 | 0.834 | 0.838 | 0.836 | 0.840 |
| Example C | 0.856 | 0.856 | 0.854 | 0.850 | 0.848 |
| Example D | 0.828 | 0.828 | 0.826 | 0.826 | 0.828 |

The results shown in Table 4 demonstrate that Examples A to D using the inventive additives have a shorter the stop time than Comparative Example 1.

TABLE 5

| | Example A (wt. %) | Example B (wt. %) | Example C (wt. %) | Example D (wt. %) | Comparative Example 1 (wt. %) |
|---|---|---|---|---|---|
| Ashless Dispersants | 3.23 | 3.23 | 3.23 | 3.23 | 3.23 |
| Detergent mixture | 1.59 | 1.59 | 1.59 | 1.59 | 1.59 |
| Example 1 | 2.08 | | | | |
| Example 2 | | 2.15 | | | |
| Example 3 | | | 1.12 | | |
| Example 4 | | | | 1.19 | |
| ZnDTP | 0.88 | 0.88 | 0.88 | 0.88 | 1.16 |
| Anti-oxidants/diluent oil | 1.91 | 1.84 | 1.87 | 1.80 | 1.82 |
| Silicone antifoam agent | 0.01 | 0.01 | 0.01 | 0.01 | 0.01 |

TABLE 5-continued

| | Example A (wt. %) | Example B (wt. %) | Example C (wt. %) | Example D (wt. %) | Comparative Example 1 (wt. %) |
|---|---|---|---|---|---|
| Pour point depressant (PMA type) | 0.30 | 0.30 | 0.30 | 0.30 | 0.30 |
| Viscosity improver (OCP type) | 8.20 | 8.20 | 8.20 | 8.20 | 8.20 |
| Group 3 base oils | Balance | Balance | Balance | Balance | Balance |
| Total, wt. % | 100.00 | 100.00 | 100.00 | 100.00 | 100.00 |
| Kinematic viscosity (ASTM D445) @100° C., $mm^2/s$ | 11.3 | 11.3 | 11.0 | 11.0 | 10.7 |
| (ASTM D445) @ 40° C., $mm^2/s$ | 68.2 | 68.4 | 65.6 | 65.7 | 63.0 |
| Viscosity Index (ASTM D2270) | 160 | 160 | 160 | 160 | 161 |
| Low temparature CCS viscosity @−30° C., m · Pas | <6600 | <6600 | <6600 | <6600 | <6600 |
| TAN, (ASTM D664) mg KOH/g | 1.83 | 1.85 | 1.86 | 1.84 | 1.81 |
| TBN, (ASTM D2896) mg KOH/g | 8.14 | 8.22 | 7.86 | 7.96 | 7.67 |
| Element, Phosphorus (ASTM D5185), ppm | 857 | 836 | 832 | 838 | 839 |
| Zinc, (ASTM D5185), ppm | 704 | 704 | 704 | 704 | 941 |
| Ca, (ASTM D5185), ppm | 2011 | 2011 | 2011 | 2011 | 2011 |
| S-Ash JIS K2272 (ASTM D874), % | 0.84 | 0.84 | 0.84 | 0.84 | 0.87 |
| Anti-wear performance (ASTM D 4172, Shell 4 ball wear) 75 C, 1200 rpm, 392N, 60 min., wear scar diameter, mm | 0.36 | 0.38 | 0.37 | 0.44 | 0.46 |
| 75 C, 1200 rpm, 392N, 60 min., wear scar diameter, mm | 0.36 | 0.39 | 0.37 | 0.44 | 0.46 |
| JASO T903: 2016, A7.3 Calculation of friction property Indices DFI = 1 + $(\mu d - \mu d_{(JATRE\text{-}B16)})/(\mu d_{(JATRE\text{-}A16)} - \mu d_{(JATRE\text{-}B16)})$ | 1.93 | 1.98 | 1.89 | 1.98 | 1.84 |
| SFI = 1 + (μs − μs(JATRE-B16))/(μs(JATRE-A16) − μs(JATRE-B16)) | 1.62 | 1.76 | 1.71 | 1.80 | 1.56 |
| STI = 1 + $(ST - ST_{(JATRE\text{-}B16)})/(ST_{(JATRE\text{-}A16)} - ST_{(JATRE\text{-}B16)})$ | 1.89 | 1.95 | 1.89 | 1.95 | 1.87 |

The performance properties of Examples A-D and Comparative 1 are also summarized in Table 5.

As can be seen in Table 5, Examples A-D demonstrate the effectiveness of Inventive Examples 1-4 to lower the sulfated ash content compared to Comparative Example 1. Similarly, the Dynamic friction index (DFI), Static friction index (SFI) and Stop time index (STI) specified in JASO T903:2016 are higher than those in Comparative Example 1, and better results are obtained in terms of anti-wear performance. From this result, it is conceivable that the wet clutch does not slip, the power is transmitted firmly, and at the same time, the shifting is performed quickly. It turns out that it is suitable for engine oils for motorcycles that simultaneously lubricates a transmission with built-in wet clutch and internal combustion engines.

It will be understood that various modifications may be made to the embodiments disclosed herein. Therefore the above description should not be construed as limiting, but merely as exemplifications of preferred embodiments. For example, the functions described above and implemented for operating are for illustration purposes only. Other arrangements and methods may be implemented by those skilled in the art without departing from the scope and spirit of this application. Moreover, those skilled in the art will envision other modifications within the scope and spirit of the claims appended hereto.

The invention claimed is:

1. A lubricating oil composition comprising a major amount of an oil of lubricating viscosity and one or more nitrogen-containing additive having the formula:

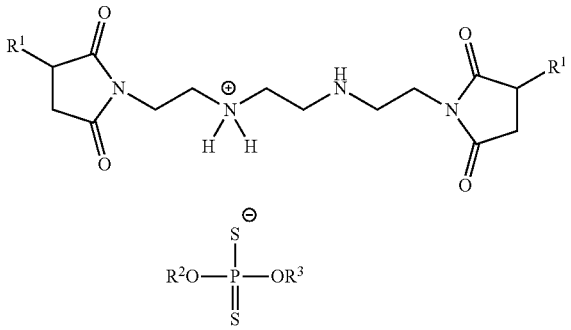

wherein $R^1$ is a functional group containing 10 to 250 carbon atoms; and $R^2$ and $R^3$ are independently functional groups containing 2 to 20 carbon atoms.

2. The lubricating oil composition of claim 1 wherein the amount of phosphorus content provided by one or more nitrogen-containing additive is from about 50 ppm to about 5000 ppm based on the total lubricating oil composition.

3. The lubricating oil composition of claim 1 wherein the composition further comprises at least one dispersant additive.

4. The lubricating oil composition of claim 3 wherein the at least one dispersant additive is an ashless succinimide or borated succinimide dispersant.

5. The lubricating oil composition of claim 1 wherein the amount of sulfated ash is from about 0.3 wt. % to about 1.2 wt. % based on the total weight of the lubricating oil composition.

6. The lubricating oil composition of claim 1 wherein $R^2$ or $R^3$ is a primary alkyl hydrocarbon of C3 to C18.

7. The lubricating oil composition of claim 6 wherein the primary alkyl hydrocarbon is 2-ethylhexyl.

8. The lubricating oil composition of claim 1 wherein $R^2$ or $R^3$ is a secondary alkyl hydrocarbon of C3 to C12.

9. The lubricating oil composition of claim 8 wherein the secondary alkyl hydrocarbons is a mixture of 2-butyl and 4-methyl-2-pentyl.

10. The lubricating oil composition of claim 1, wherein the lubricating oil composition contains less than about 900 ppm of zinc.

11. A method of increasing the friction coefficient of a wet clutch comprising contacting a metal surface with a lubricating oil composition comprising a major amount of an oil of lubricating viscosity and one or more nitrogen-containing additive having the formula:

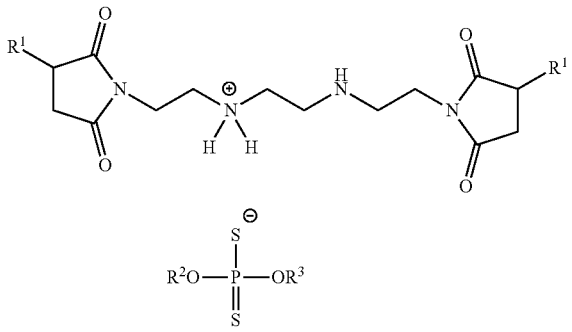

wherein $R^1$ is a functional group containing 10 to 250 carbon atoms; and $R^2$ and R3 are independently functional groups containing 2 to 20 carbon atoms.

12. The method of claim 11 wherein the amount of phosphorus content provided by one or more nitrogen-containing additive is from about 50 ppm to about 5000 ppm based on the total lubricating oil composition.

13. The method of claim 11 wherein the composition further comprises at least one dispersant additive.

14. The method of claim 13 wherein the at least one dispersant additive is an ashless succinimide or borated succinimide dispersant.

15. The method of claim 11 wherein the amount of sulfated ash is from about 0.3 wt. % to about 1.2 wt. % based on the total weight of the lubricating oil composition.

16. The method of claim 15 wherein $R^2$ or $R^3$ is a primary alkyl hydrocarbon of C3 to C18.

17. The method of claim 16 wherein the primary alkyl hydrocarbon is 2-ethylhexyl.

18. The method of claim 11 wherein $R^2$ or $R^3$ is a mixture of secondary alkyl hydrocarbons.

19. The method of claim 18 wherein the mixture of secondary alkyl hydrocarbons is 2-butyl and 4-methyl-2-pentyl.

20. The method of claim 11, wherein the wet clutch contains cellulose fiber and/or aramid fiber.

* * * * *